US005551365A

United States Patent [19]

Cipolla et al.

[11] Patent Number: 5,551,365

[45] Date of Patent: Sep. 3, 1996

[54] WATER VEHICLE AND A DIRECTIONAL CONTROL MEANS THEREFOR

[75] Inventors: Jeffrey L. Cipolla, Newport, R.I.; Ronald E. Waclawik, Fairhaven, Mass.; Charles L. Elste, Portsmouth, R.I.

[73] Assignee: The United States of America as represented by the Secretary of the Navy, Washington, D.C.

[21] Appl. No.: 411,236

[22] Filed: Mar. 27, 1995

[51] Int. Cl.[6] ..... F42B 19/06

[52] U.S. Cl. ..... 114/23; 114/144 R; 114/330

[58] Field of Search ..... 114/23, 20.1, 163, 114/162, 144 R, 280, 282, 274, 330, 331

[56] References Cited

U.S. PATENT DOCUMENTS

| | | | |
|---|---|---|---|
| 1,295,355 | 2/1919 | Myers | 114/20.1 |
| 1,410,877 | 3/1922 | Bell et al. | 114/280 |
| 2,914,014 | 11/1959 | Carl et al. | 114/281 |
| 2,980,047 | 4/1961 | Korganoff et al. | 114/313 |
| 3,459,146 | 8/1969 | Prior | 114/280 |
| 4,207,830 | 6/1980 | Wankel | 114/274 |
| 4,569,302 | 2/1986 | Gruzling | 114/63 |
| 4,890,568 | 1/1990 | Dolengowski | 114/246 |

*Primary Examiner*—Michael J. Carone
*Assistant Examiner*—Christopher K. Montgomery
*Attorney, Agent, or Firm*—Michael J. McGowan; Michael F. Oglo; Prithvi C. Lall

[57] ABSTRACT

There is presented in combination, a water vehicle and a directional control means therefor. The water vehicle includes at least a portion thereof which is underwater during travel of the vehicle through water. The directional control means comprises a plurality of symmetrically disposed arms extendible from sides of the underwater portion of the vehicle. The arms each include a multiplicity of fins in a compact array for contact with the water through which the vehicle portion moves, each of the fins having an uncambered, neutral lift cross-section matching the hydrodynamic streamline flow thereabout at predetermined vehicle speed below the cavitation threshold.

16 Claims, 7 Drawing Sheets

WATER VEHICLE AND A DIRECTIONAL CONTROL MEANS THEREFOR

STATEMENT OF GOVERNMENT INTEREST

The invention described herein may be manufactured and used by or for the Government of the United States of America for governmental purposes without payment of any royalties thereon therefor.

CROSS-REFERENCE TO RELATED PATENT APPLICATIONS

This patent application is co-pending with three related patent applications entitled A Water Vehicle And A Directional Control Device Therefor Ser. No. 08/411,237, filed 27 Mar. 1995, An Underwater Vehicle And Combination Directional Control And Cable Interconnect Device Ser. No. 08/411,235, filed 27 Mar. 1995, and An Underwater Vehicle And Combination Directional Control And Cable Interconnect Means Ser. No. 08/411,234, filed 27 Mar. 1995.

BACKGROUND OF THE INVENTION (1) Field of the Invention

This invention relates to a water vehicle and directional control means therefor, and is directed more particularly to a water vehicle having at least a portion thereof underwater during travel of the vehicle through water and directional control means extendible from the vehicle and operative in an underwater environment to maneuver the vehicle.

(2) Description of the Prior Art

Current directional control devices for water vehicles are of two basic types, fins and thrusters. Fins typically are mounted at the aft end of the vehicle or, in the case of an underwater vehicle, on the sail or bow. The effect of fins on the directional control of the vehicle is proportional to the flow rate across the fins. Thus, at low speeds the effectivenes of fins is diminished. Thrusters are effective at low speeds because they produce their own flow, but are noisy, consume power, occupy more space, and are more complex and expensive than fins.

There is thus a need for a fin-type control means which is effective at low vehicle speeds.

SUMMARY OF THE INVENTION

It is, therefore, an object of the invention to provide a water vehicle and directional control means therefor, the latter comprising a fin-type device effective for directional control at low vehicle speeds.

With the above and other objects in view, as will hereinafter appear, a feature of the present invention is the provision of a water vehicle and, in combination therewith, directional control means, the water vehicle having at least a portion thereof underwater during travel of the vehicle through water, the directional control means comprising a plurality of symmetrically disposed arms extendible from the underwater portion of the vehicle. Each of the arms includes a multiplicity of fins in a compact array for contact with the water through which the vehicle portion moves in its travel, each of the fins of the array having an uncambered, neutral lift cross-section matching the hydrodynamic streamline flow thereabout at predetermined vehicle speed below the cavitation threshold.

The above and other features of the invention, including various details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
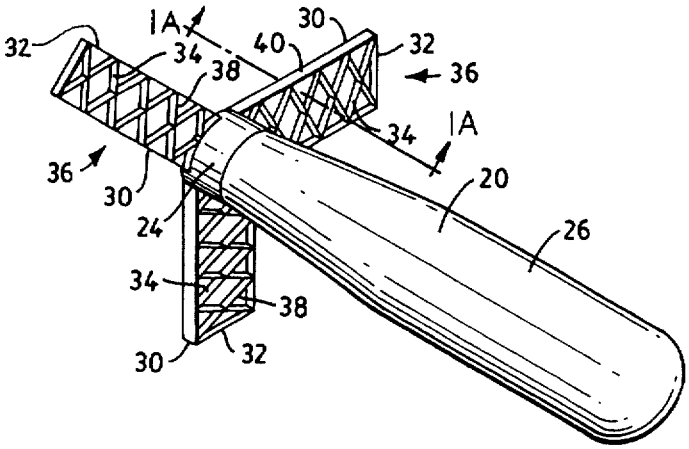
FIG. 1 is a perspective view of a water vehicle in combination with a directional control means, illustrative of embodiment of the invention.
Figure 2:
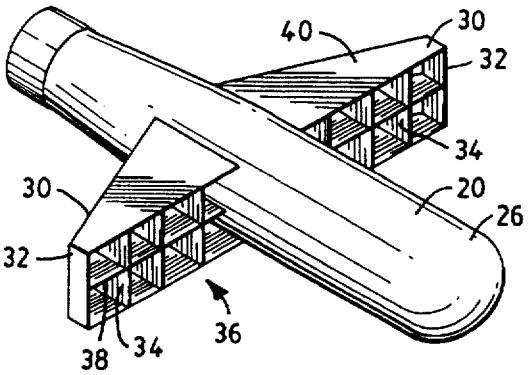
FIG. 2 is a perspective view, similar to FIG. 1, illustrative of an alternative embodiment of the invention.

Referring to FIG. 1, it will be seen that an illustrative combination of water vehicle 20 and directional control means 30 includes an underwater vehicle 20 and a plurality of symmetrically disposed arms 32 extending from an aft portion 24 of the vehicle 20. The vehicle 20 includes at least a portion 26 thereof which remains submerged during travel of the vehicle 20 through the water. When the vehicle 20 is a torpedo 22 (FIGS. 1 and 2) or other underwater vehicle (FIG. 3), the entire vehicle is underwater throughout the travel of the vehicle. However, in the case of surface vessels (FIG. 4), only a portion of the hull is underwater when the vessel is underway.

Figure 1A:
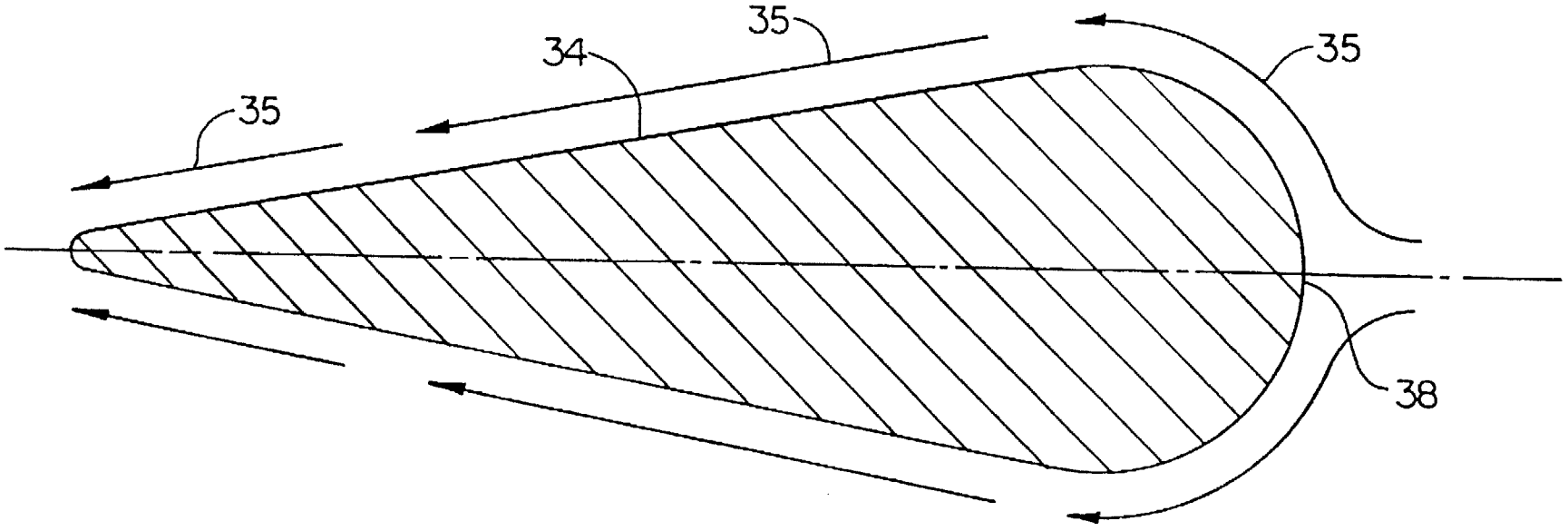
FIG. 1A is a somewhat diagrammatic section of a fin element of the directional control means taken along section line 1A—1A of FIG. 1.

Each of the arms 32 includes a multiplicity of fins 34 in a compact array 36 for contact with the water through which the vehicle moves. Referring now to FIG. 1A, each fin 34 preferably has a neutral-lift, uncambered, shape of cross section chosen to substantially match the hydrodynamic streamlines about the fin present during movement of vehicle 20 through water at below-cavitation-threshold speed, represented by flow arrows 35. Such shape of streamlines is obtainable employing principles of analysis known to those having skill in the art. One such embodiment, shown in FIG. 1A, has a cross sectional shape of an ellipsoidal leading edge 38 with a taper pinched trailing edge.

The array 36 of many relatively short fins oriented generally in the direction of water flow about the vehicle, presents a large surface area when disposed at a selected angle to the flow. The device produces a high force/moment, even at low speeds.

Figure 3:
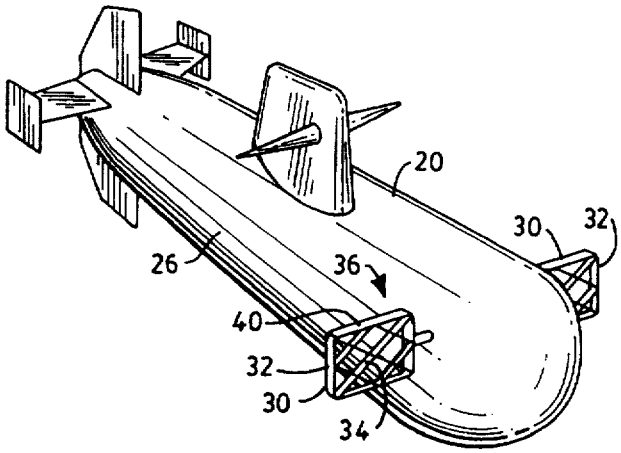
FIG. 3 is a perspective view, similar to FIG. 2, illustrative of another alternative embodiment of the invention.
Figure 4:
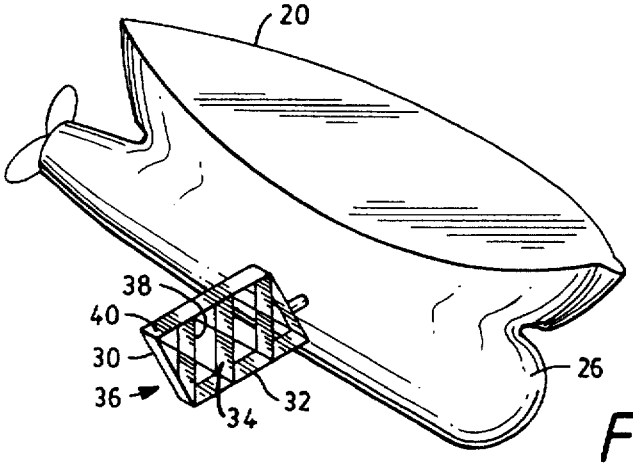
FIG. 4 is a perspective view, similar to FIG. 2, illustrative of another alternative embodiment of the invention.
Figure 5:
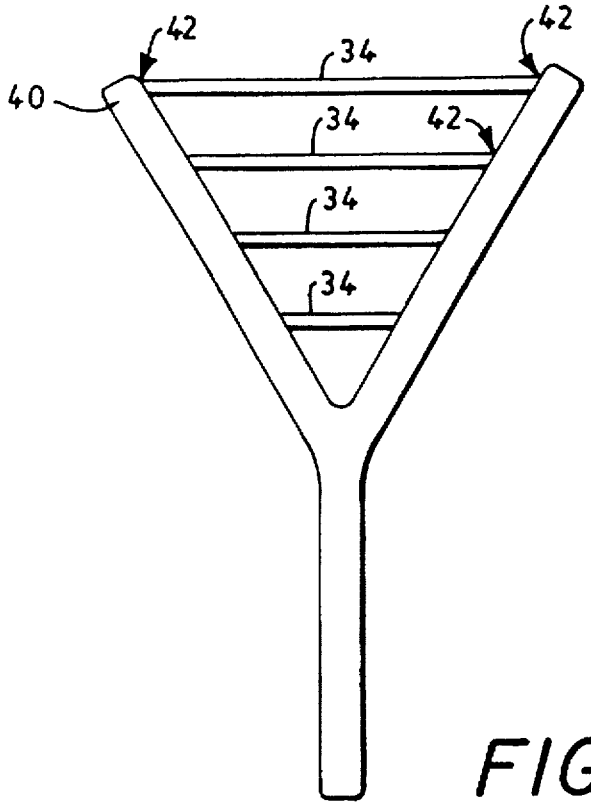
FIGS. 5 and 6 are front elevational views of control devices, illustrative of alternative embodiments thereof.

Two or more compact arrays 36 are mounted on the vehicle 20 at the aft end (FIG. 1), amidship (FIG. 2), or in a bow position (FIG. 3). The fins 34 may be surrounded by, and attached to, a shroud 40, as shown in FIGS. 1–4, or may be of a configuration, as shown in FIG. 5 wherein all ends 42 of fins 34 are fixed to the shroud 40 but the shroud does not necessarily surround the fins.

Figure 6:
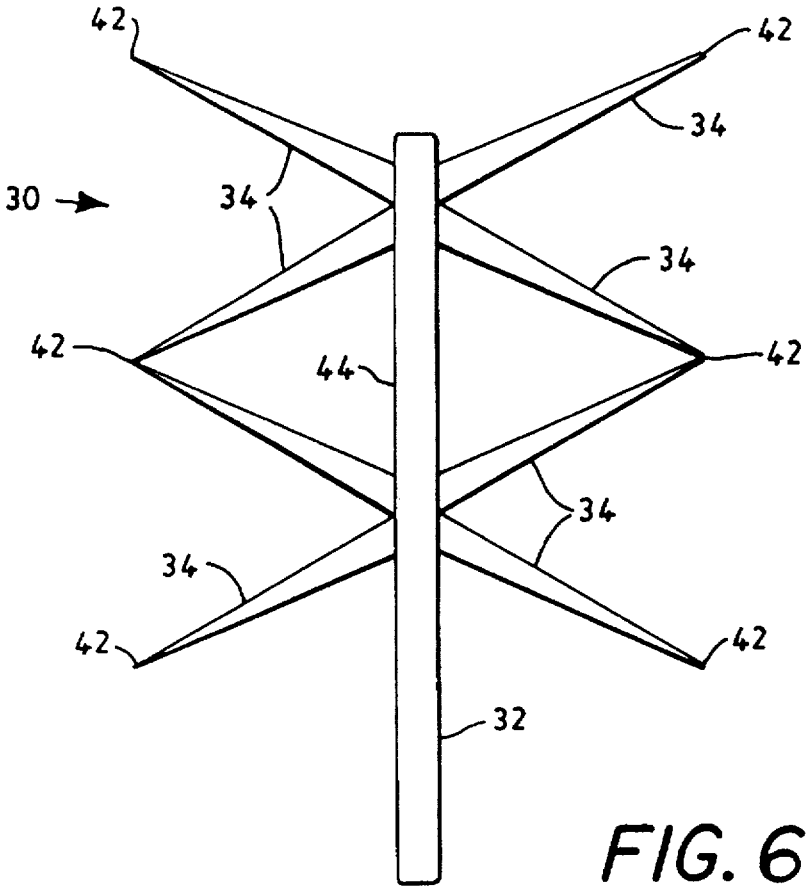

In FIG. 6, there is illustrated an embodiment of the control device 30 in which fins 34 are mounted on a central post 44, with ends 42 of fins 34 exposed.

Figure 7:
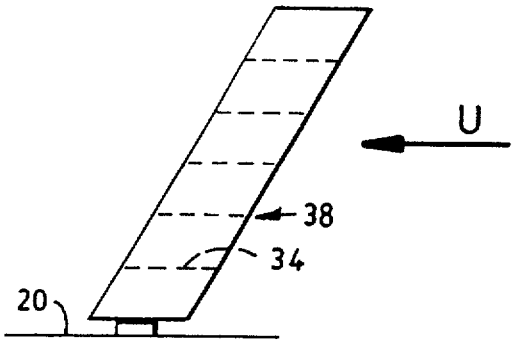
FIGS. 7 and 8 are side elevational views of control devices, illustrative of alternative operative dispositions thereof.
Figure 8:
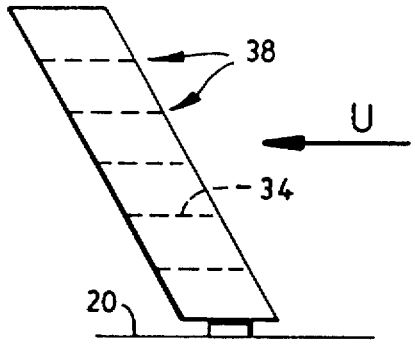

While the arms 32 shown in FIGS. 1–4 extend outwardly, substantially normal to the axis of the vehicle, it will be seen in FIGS. 7 and 8 that the array 36 of fins may be extended in a position angled forwardly (FIG. 7) against the direction U of water flow, or rearwardly (FIG. 8). The array may be curved, as shown in FIG. 10.

Figure 9:
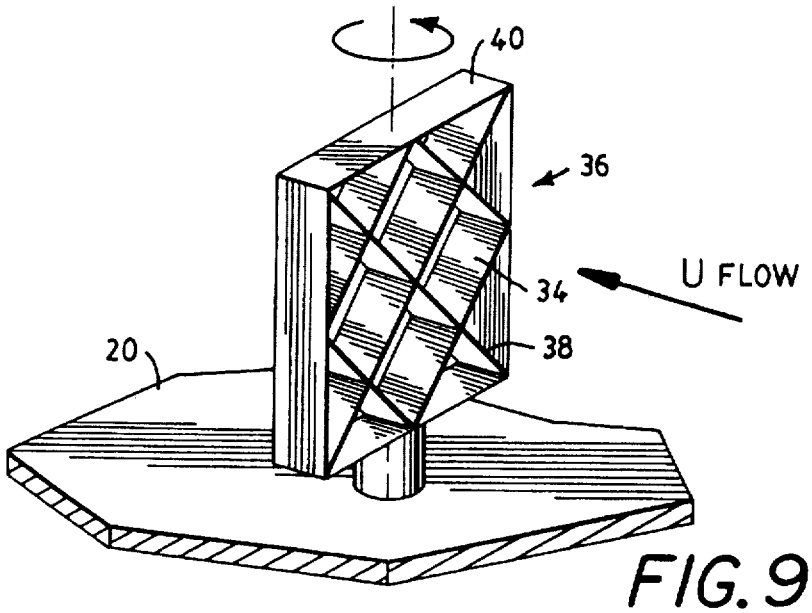
FIGS. 9 and 10 are perspective views of control devices adapted for rotative movement.
Figure 10:
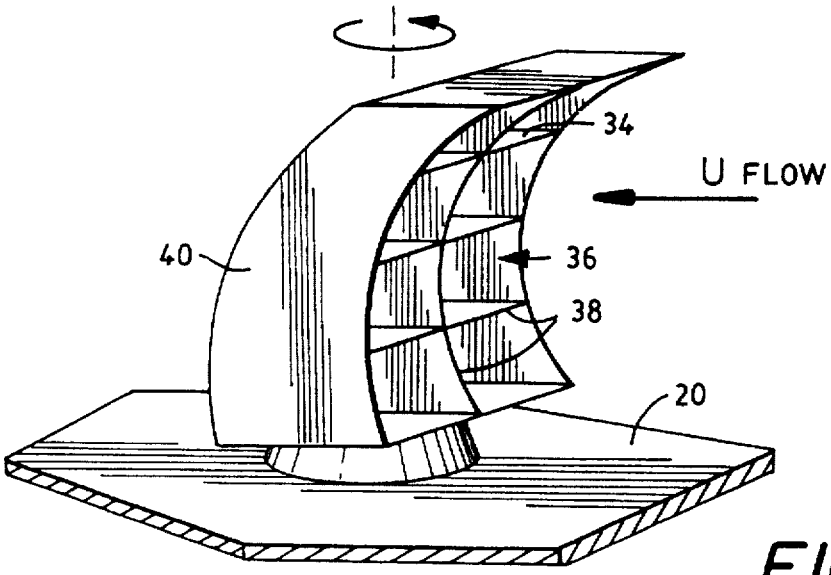
Figure 11:
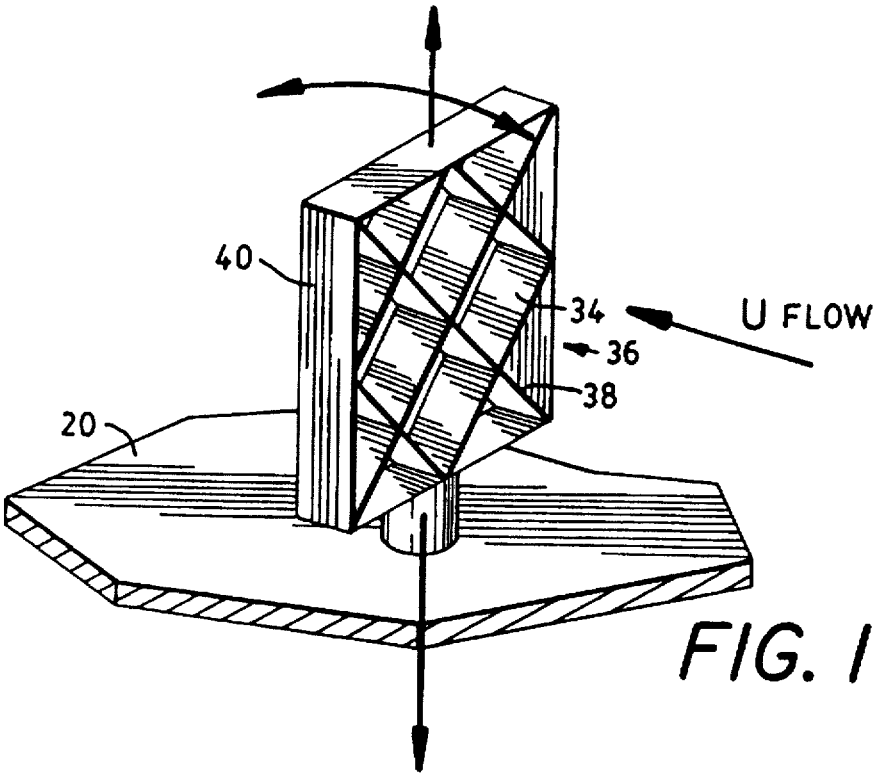
FIGS. 11 and 12 are perspective views of control devices adapted for hinged movement forwardly and rearwardly.
Figure 12:
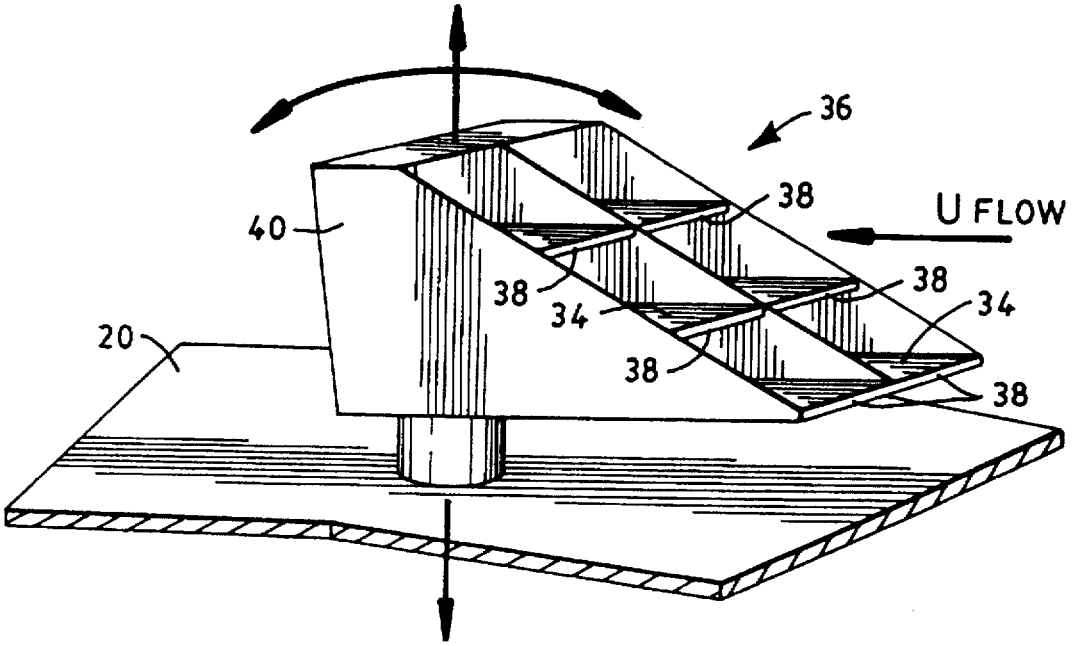
Figure 16:
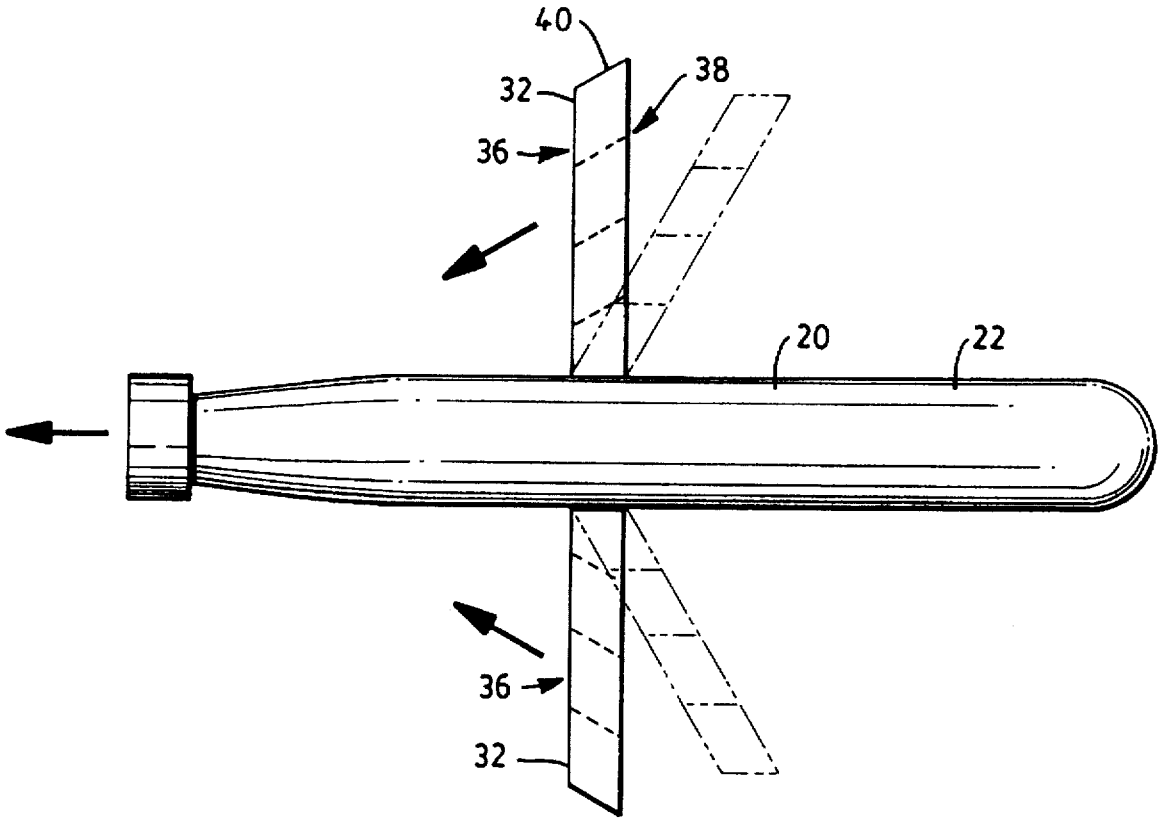
FIG. 16 is a top plan view of a vehicle having control devices of the type shown in FIG. 11.

Referring to FIGS. 9 and 10, it will be seen that array 36 may be rotatably mounted on the vehicle 20. Referring to FIGS. 11, 12 and 16, it will be seen that array 36 may be hingedly mounted, so as to be tiltable forwardly and/or rearwardly.

Figure 13:
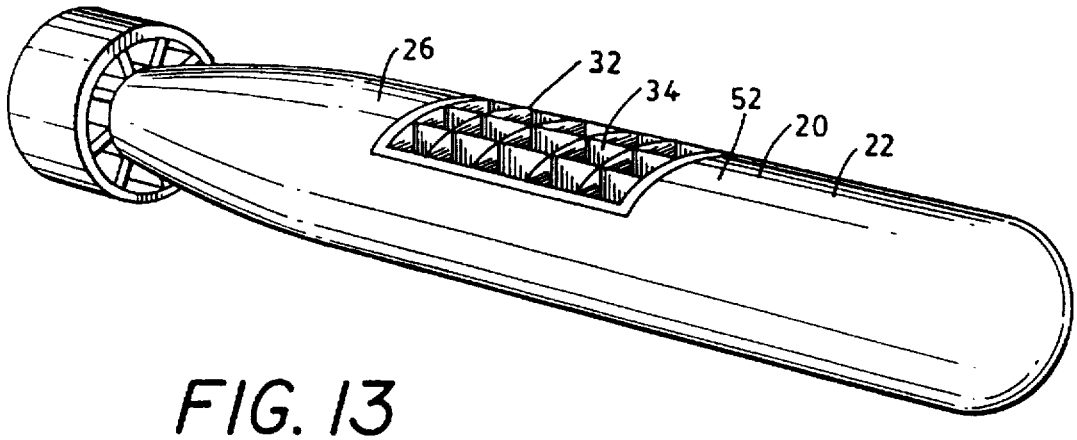
FIG. 13 is a perspective view of a water vehicle having a pocket therein for stowing of a directional control device, such that the device is conformable to the vehicle.
Figure 14:
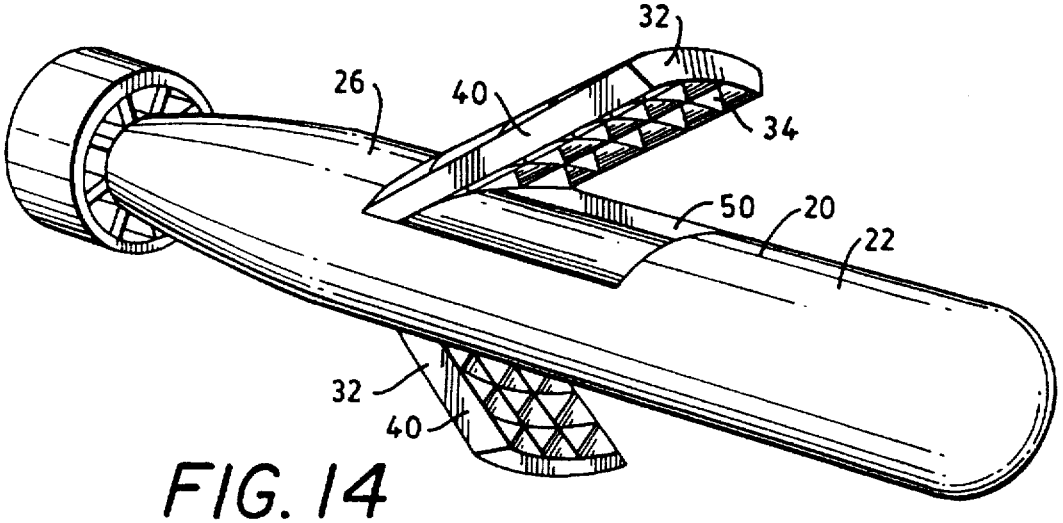
FIG. 14 is a perspective view similar to FIG. 13, but illustrative of movement of the control device from a stowed position to a deployed position.
Figure 15:
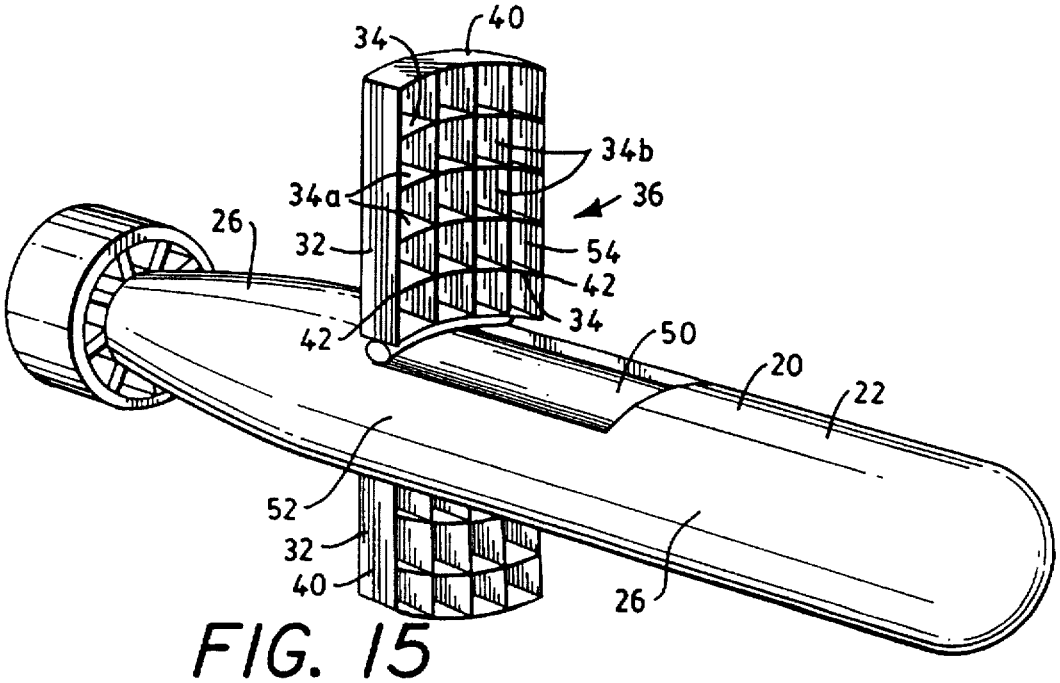
FIG. 15 is a perspective view of similar to FIG. 14, but illustrative of the control device of FIG. 15 in its deployed position.

As illustrated in FIGS. 13–15 vehicle 20 preferably is provided with pockets 50 in the underwater portion 26 thereof. The arms 32 are movable between positions in pockets 50 wherein arms 32 substantially conform to an exterior surface 52 of vehicle 20 (FIG. 13) and a deployed position wherein arms 32 extend outwardly from exterior surface 52 of vehicle 20.

As seen in FIG. 15, the array 36 of fins 34 may include a plurality of first fins **34*a* parallel to each other, and a plurality of second fins 34*b* parallel to each other and normal to first fins 34*a*. The first and second fins 34*a*, 34*b* intersect to form a grid-like configuration, with ends 42 of fins 34 fixed to an inside surface 54 of shroud 40**.

In the embodiment illustrated in FIGS. 13–15, arms 32 may be extended by hydrodynamic forces acting thereon as vehicle 20 is launched, or may be extended by spring pressure which operates to fling arms 32 to the deployed position upon exit of the vehicle from a launch tube. Alternatively, the arms 32 may be selectively extended by power means operative upon signal from a transmitting station, or operable automatically upon lapse of a selected time, or the like.

In operation, during tube launch, or when vehicle 20 is moving at high speed, or when the arrays 36 are otherwise not needed, arms 32 are folded conformal to the body of vehicle 20. Upon deployment, the arrays present fins 34 substantially parallel to the direction of flow, minimizing drag. Yaw, pitch, and turning control forces are imparted by angling the array with respect to flow, that is, by angling the array forwardly or rearwardly, or by rotating the array.

There is thus provided a water vehicle in combination with directional control means which afford high forces/moments at low speeds, simple operation, low power consumption, low acoustic signature and conformability to a launch tube.

It is to be understood that the present invention is by no means limited to the particular construction herein disclosed and shown in the drawings, but also comprises any modifications or equivalents within the scope of the claims. For example, while several specific arrangements of fins are illustrated, the fin arrays may be of any shape consistent with incompressible hydrodynamic flow, and may be optimized for lift, drag and/or cavitation properties of a particular vehicle at foreseen speed ranges.

What is claimed is:

1. In combination, a water vehicle and directional control means therefor, said combination comprising:

a water vehicle having at least a portion thereof underwater during travel of said vehicle through water;

a directional control means comprising a plurality of symmetrically disposed arms extendible from sides of said portion of said vehicle, each of said arms including a multiplicity of fins in a compact array for contact with said water through which said vehicle portion moves in said travel, each of said arms further including a shroud surrounding said array of fins;

each of said fins having a neutral-lift, uncambered, shape of cross section chosen to substantially match the hydrodynamic streamline flow about the fin at a predetermined vehicle speed below cavitation threshold speed; and wherein said arrays of fins include a plurality of first fins parallel to each other, and a plurality of second fins parallel to each other and normal to said first fins, said first and second fins intersecting to form a grid-like configuration, with ends of said fins fixed to an inside surface of said shroud.

2. The combination in accordance with claim 1 wherein said shape of cross section of the fins comprises a generally ellipsoidal leading edge with a taper pinched trailing edge.

3. The combination in accordance with claim 1 wherein said arms are rotatable about their axes.

4. The combination in accordance with claim 1 wherein said arms are movable so as to be angled forwardly and rearwardly.

5. The combination in accordance with claim 1 wherein said arms are hingedly movable in a fore-and-aft direction.

6. The combination in accordance with claim 1 wherein said arms extend from said side of said vehicle each at an attitude angled forwardly.

7. The combination in accordance with claim 1 wherein said arms extend from said side of said vehicle each at an attitude angled rearwardly.

8. The combination in accordance with claim 1 wherein said arms are extendible by power means.

9. The combination in accordance with claim 1 wherein said water vehicle comprises an underwater vehicle and said arms remain underwater during said travel of said vehicle through water.

10. The combination in accordance with claim 1 wherein said water vehicle portion remains underwater during said travel of said vehicle through water and said arms remain underwater during said travel of said vehicle.

11. In combination, a water vehicle and directional control means therefor, said combination comprising:

a water vehicle having at least a portion thereof underwater during travel of said vehicle through water;

a directional control device comprising a plurality of arms extendible from sides of said portion of said vehicle, each of said arms including a multiplicity of fins in a compact array for contact with said water through which said vehicle portion moves in said travel;

each of said fins having a neutral-lift, uncambered, shape of cross section chosen to substantially match the hydrodynamic streamline flow about the fin at a predetermined vehicle speed below cavitation threshold speed; and wherein said vehicle is provided with pockets in said underwater portion of said vehicle, and each of said arms is movable between a position in one of said pockets wherein said arm substantially conforms to the exterior surface of said vehicle portion and a deployed position wherein said arm extends outwardly from said exterior surface of said vehicle.

12. The combination in accordance with claim 11 wherein said vehicle is an underwater vehicle launchable by a submerged submarine, and said arms in said pockets conform to a cylindrical configuration of said exterior surface of said vehicle to facilitate launch of said vehicle through a launch tube of said submarine.

13. The combination in accordance with claim 12 wherein upon launch of said vehicle said arms are extendible by hydrodynamic forces acting thereon.

14. The combination in accordance with claim 12 wherein upon launch of said vehicle said arms are extendible by spring pressure.

15. The combination in accordance with claim 11 wherein each of said arms comprise a central post and said fins extend outwardly from said post.

16. The combination in accordance with claim 15 wherein distal ends of said fins are exposed.

* * * * *